US005826731A

United States Patent [19]

Dardashti

[11] Patent Number: 5,826,731

[45] Date of Patent: Oct. 27, 1998

[54] KNOCK-DOWN BOTTLE RACK

[76] Inventor: Shahriar Dardashti, c/o Atlantic Representations, Inc., P.O. Box 2399, Santa Fe Springs, Calif. 90670

[21] Appl. No.: 614,964

[22] Filed: Mar. 11, 1996

[51] Int. Cl.[6] ..... A47B 73/00

[52] U.S. Cl. ..... 211/74; 211/181

[58] Field of Search ..... 211/74, 181, 189, 211/194; 206/139, 223, 427; D7/701, 704, 706, 619

[56] References Cited

U.S. PATENT DOCUMENTS

| | | | |
|---|---|---|---|
| D. 216,690 | 3/1970 | Robak | D26/1 |
| D. 260,463 | 9/1981 | Imus | D7/704 X |
| 1,751,505 | 3/1930 | Borland, Jr. | 211/163 |
| 2,527,796 | 10/1950 | Clute | 211/74 |
| 2,591,362 | 4/1952 | Koch | 211/74 |
| 3,003,644 | 10/1961 | Hildebrand | 211/74 |
| 3,160,278 | 12/1964 | Varkala | 211/74 |
| 3,606,023 | 9/1971 | Edmunds | 211/74 |
| 3,901,389 | 8/1975 | Belokin, Jr. | 211/74 |
| 4,589,556 | 5/1986 | Peretz | 248/310 X |
| 4,679,695 | 7/1987 | Leff | 211/71 |
| 4,998,631 | 3/1991 | Fridjhon | 211/74 |
| 5,025,936 | 6/1991 | Lamoureaux | D7/701 X |
| 5,215,199 | 6/1993 | Bejarano | 211/74 |
| 5,236,094 | 8/1993 | Condie | 211/26 X |

*Primary Examiner*—Korie Chan
*Assistant Examiner*—Sandra Snapp
*Attorney, Agent, or Firm*—Poms, Smith, Lande & Rose, P.C.

[57] ABSTRACT

A wine rack having four wire panels of bottle holders and a wire base assembly, each being a separate component and packaged together in a small carton. The two lower panels are fitted into the base assembly, the two upper panels are fitted into the tops of respective lower panels, and the panels are all clipped together. The two lower panels are also cradled in a cross bar of the base assembly. All of the bottles, when held in storage positions in the rack, are sloped downwardly at an angle towards their cork ends. The bottles on one panel-column side face one direction and those on the other face the other direction. The entire unit with its snap-fit and clipped connections and its balanced bottle arrangement can be safely lifted at its top when fully loaded with bottles.

65 Claims, 5 Drawing Sheets

FIG. 3
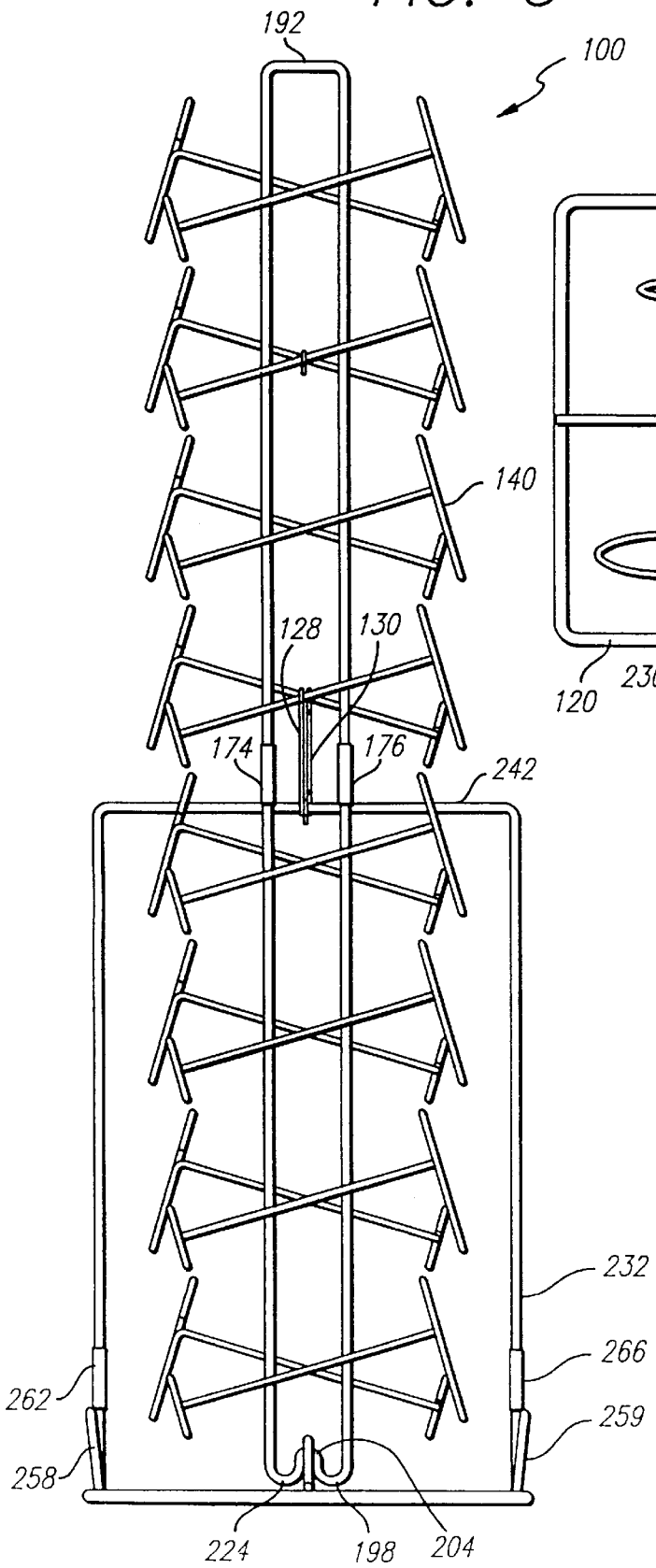
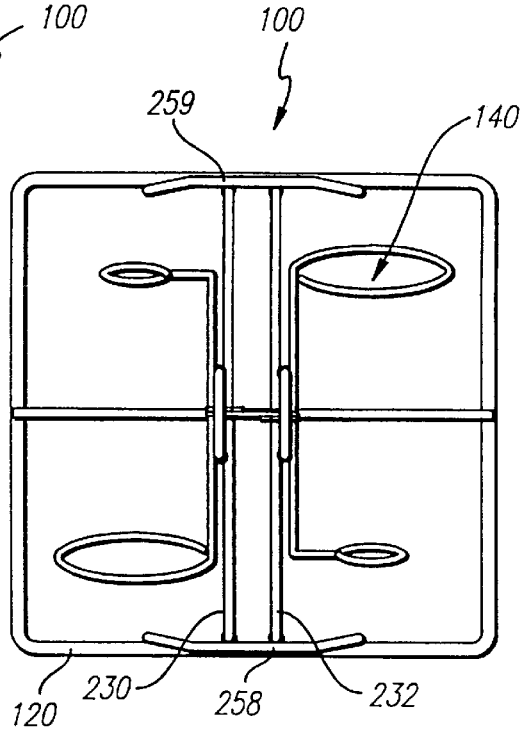
FIG. 4
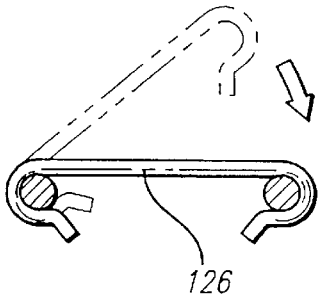
FIG. 8

FIG. 5
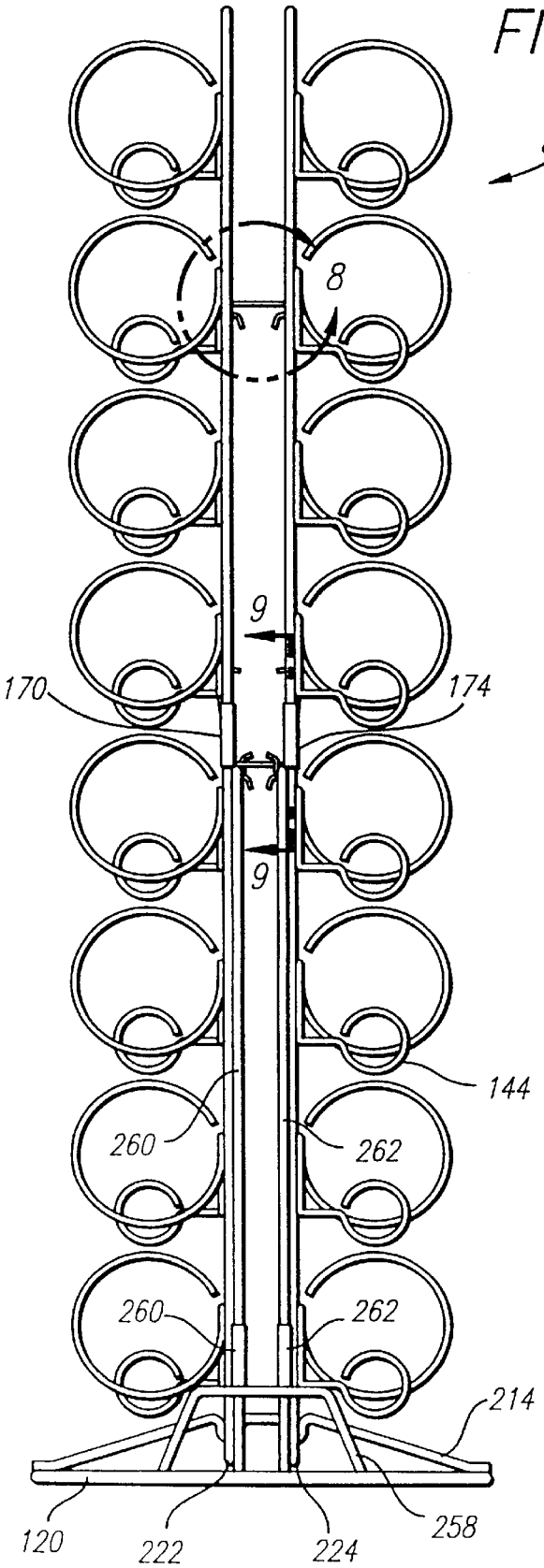
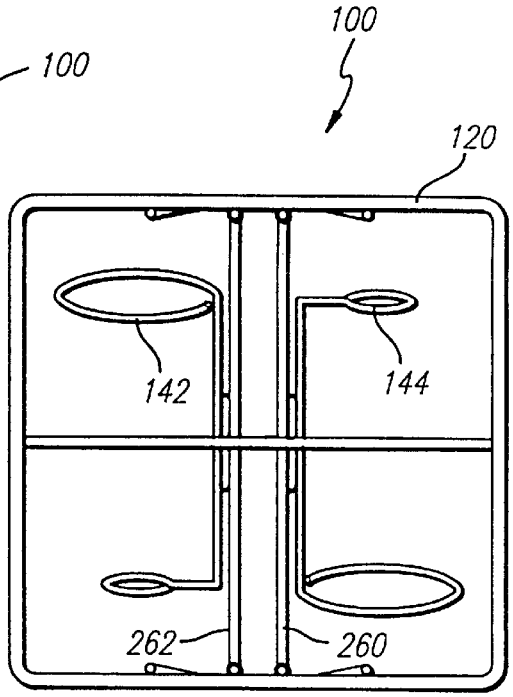
FIG. 6
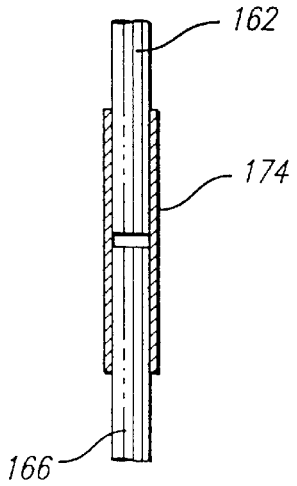
FIG. 9

KNOCK-DOWN BOTTLE RACK

BACKGROUND OF THE INVENTION

The present invention relates to wine racks, particularly those made of wire, and to methods of assembling them.

An example of a prior art wine rack is shown in FIG. 1 generally at 50. This wine rack is manufactured and distributed as a single unitary unit. As can be appreciated, this is a large unit to box and ship, cumbersome, expensive and occupying a large amount of storage, shipping and display space. Two columns 54, 56 of parallel bottle holders 58, 60 are provided in this wine rack 50. Each of the holders 58, 60 has a small circle 64, a large circle 68 and a wire rod 70 holding them in fixed spaced relation to define a bottle holding, sleeve-like structure. The bottle 74 is held with its neck 76 in the small circle 64 and its body 80 in the large circle 68. All of the bottles 74 are stored in the rack 50 facing the same way, horizontally disposed, and aligned in two parallel columns and supported on a round wire base 84. This makes for an unbalanced front-to-back weight distribution of the heavy bottles.

Another example of a prior art wine rack is that shown in the September 1973 issue of "House Beautiful" at page 155. That rack is simply a three-dimensional grid structure constructed of wood pieces forming in an end (or front) view rows and columns of aligned slots, each for receiving and holding a separate bottle in a level horizontal orientation. The wood pieces in the bottle longitudinal direction (the z direction) are thicker and heavier than those in the other two (x and y) directions. The racks are configured to hold six bottles each, and additional racks (modules) can be stacked side-by-side or piled on top of one another as needed to store additional bottles.

SUMMARY OF THE INVENTION

Directed to remedying the problems in the prior art, disclosed herein is an improved wire wine rack. The wine rack is manufactured, packaged, stored and shipped disassembled and in small cartons or boxes. This makes for more compact shipping, storage and even display thereof in retail establishments. The user or purchaser need only carry by hand or car to his home a small box, and not a large box such as is needed for the wine rack of FIG. 1. Only some very quick and easy assembly is required by the user.

Assembly can be done easily and with minimal frustration even by those most averse to putting things together, by simply looking at a picture of the assembled wine rack or following easy instructions. The picture and/or instructions can be printed on the box itself and/or on a separate insert sheet packaged in the box.

In any event, the box is opened, the components removed and assembled as now described. The components include four wire panels, each including a plurality of bottle holders, and a base assembly. Two of the panels are fitted in back-to-back orientation into sleeves of the base assembly, and set into central cradles of the base assembly. Those two panels have upward sleeves into which the other two panels are fitted. The panels are then clipped together with simple wire clips, also provided in and removed from the box, to provide a secure connection. The connection is secure enough so that the entire rack assembly can be lifted at its top without coming apart, even when fully loaded with bottles. Each of the panels can have four bottle holders, whereby when assembled two parallel columns of eight bottles supported by the base assembly are provided. All of the bottles are held tilted downward at a slight angle. And bottles on the columns face in opposite directions to provide a good weight balance for this rack.

Other objects and advantages of the present invention will become more apparent to those persons having ordinary skill in the art to which the present invention pertains from the foregoing description taken in conjunction with the accompanying drawings.

BRIEF DESCRIPTION OF THE DRAWINGS

FIG. 3 is a right side elevational view thereof; the left side elevational view being a mirror image thereof;

FIG. 4 is a top plan view thereof;

FIG. 5 is a front elevational view thereof; the rear elevational view being a mirror image thereof;

FIG. 6 is a bottom plan view thereof;

FIG. 8 is an enlarged perspective view taken on circle 8 of FIG. 5 showing the operation of one of the clips of FIG. 7; and FIG. 9 is an enlarged cross-sectional view taken on line 9—9 of FIG. 5 showing the fitting arrangement of one of the wire frame ends of FIG. 7.

DETAILED DESCRIPTION OF PREFERRED EMBODIMENTS OF THE INVENTION

Figure 1:
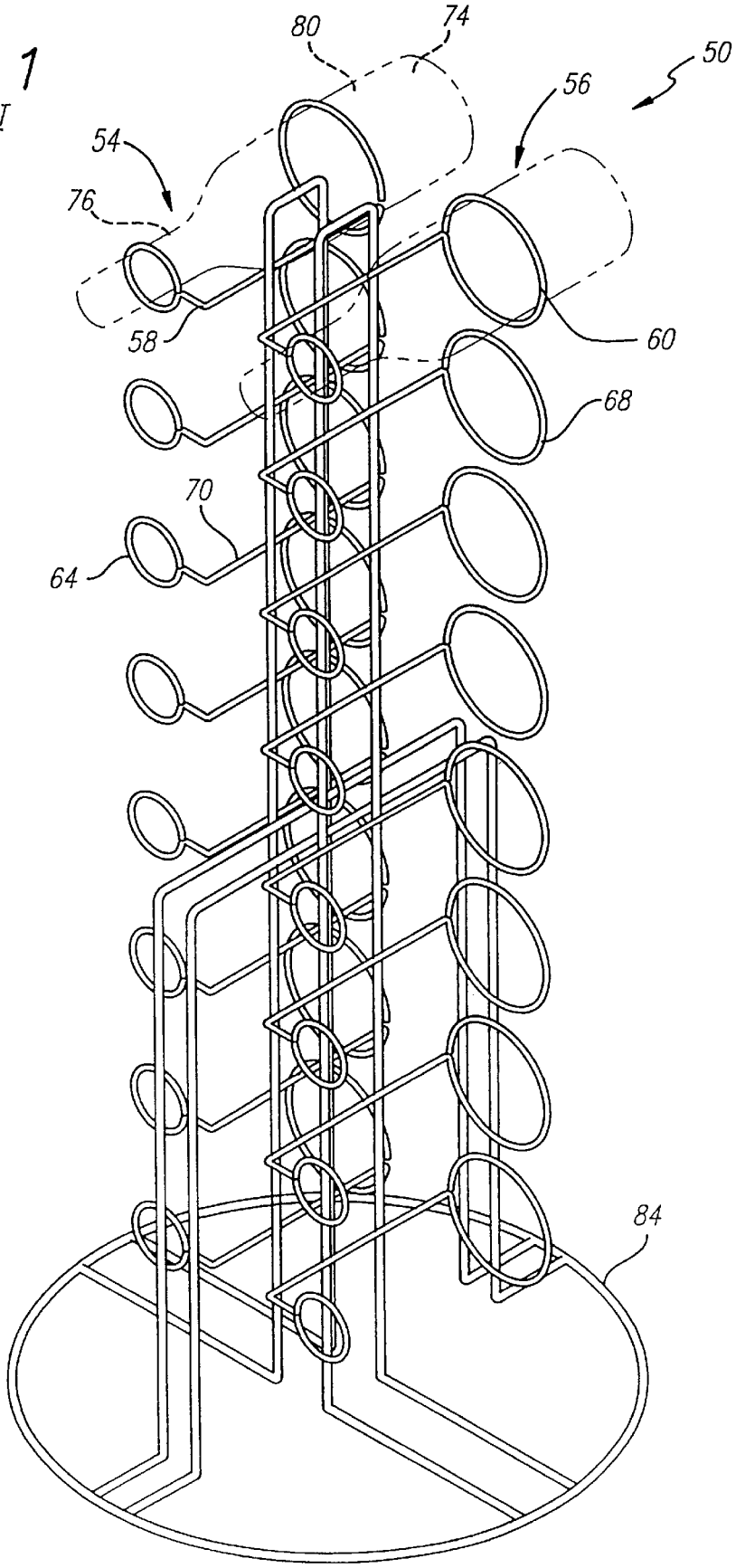
FIG. 1 PRIOR ART
FIG. 1 is a perspective view of a wine rack of the prior art.
Figure 2:
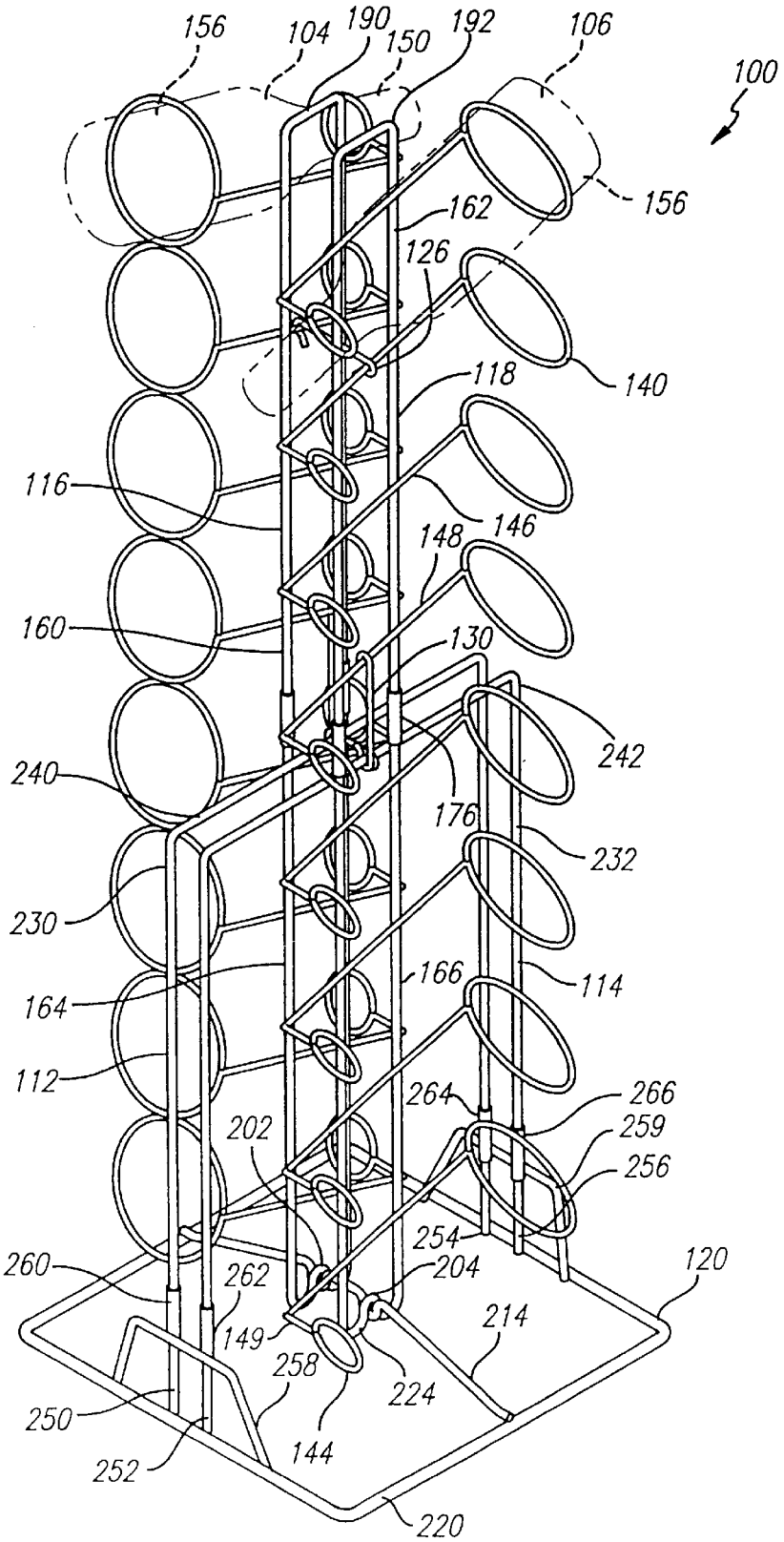
FIG. 2 is a perspective view of an assembled wine rack of the present invention.

A wire wine bottle rack of the present invention is shown generally at 100 assembled. Examples of wine bottles held therein are shown by dotted lines at 104 and 106. As can be readily seen and unlike the prior art wine rack 50 of FIG. 1, the bottles 104, 106 on both sides face in opposite directions and slope downwardly approximately ten to forty degrees. This sloping angle may be more apparent from FIGS. 3 and 5 than the perspective view of FIG. 2.

Figure 7:
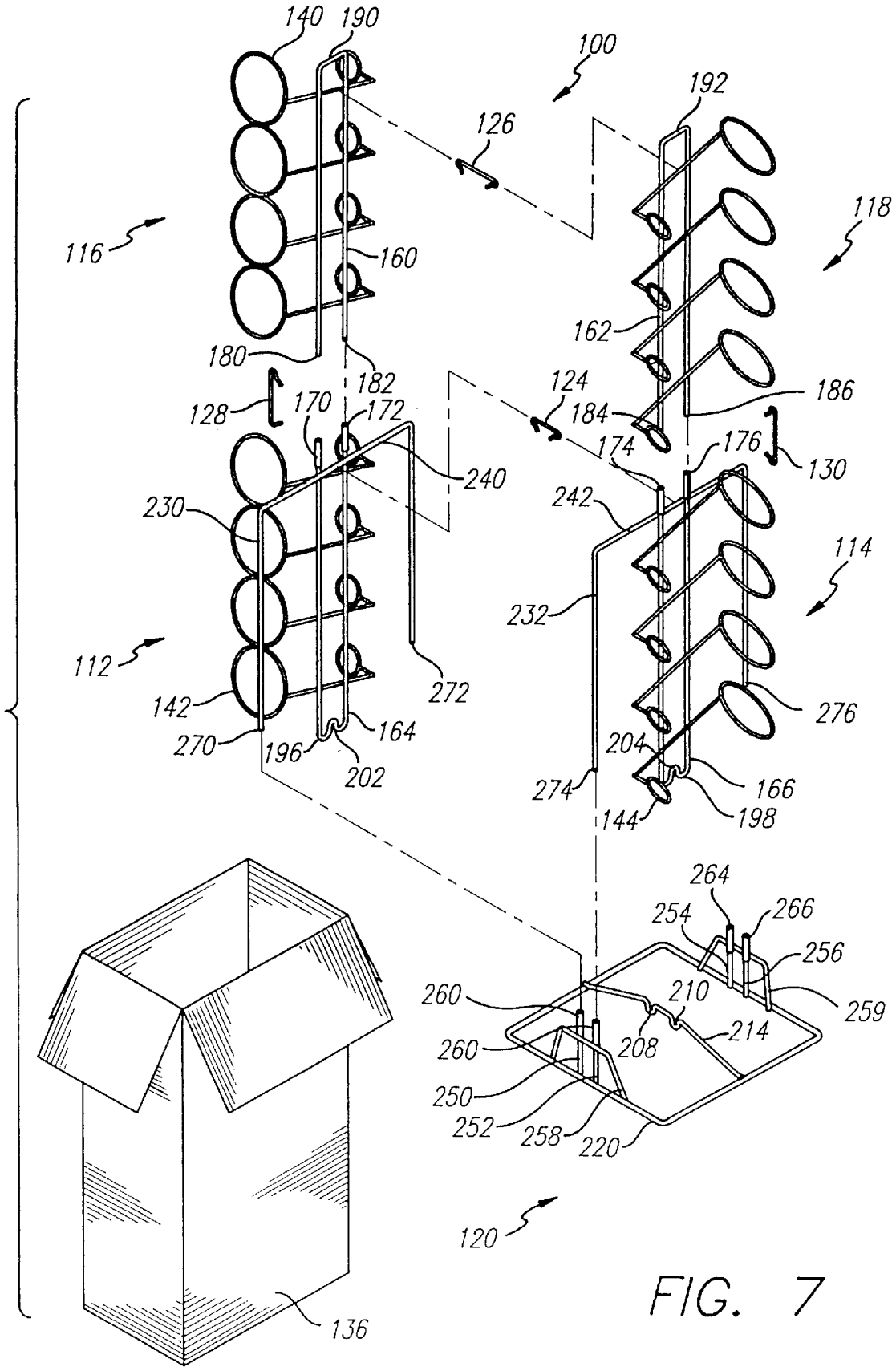
FIG. 7 is an exploded perspective view thereof, also showing a storage and shipment container therefor.

The knock-down wine bottle rack 100 is formed with four wire panels 112, 114, 116, 118, a wire base assembly 120 and four clips 124, 126, 128, 130, as best shown in FIG. 7. These components are provided disassembled and packaged in a small box 136, which is easy, convenient and compact to store, ship and display. The box 136 is easy for the customer to transport to his home or business and remove the components therefrom and quickly and easily assembled them. He (or she) can assemble the rack 100 simply from an assembled picture on the box 136 itself or from easy instructions (which might include a view similar to that of FIG. 7) provided on the box or on a separate instruction sheet (not shown) provided in the box.

The left and right lower panels 112, 114 are mirror images of each other; similarly the left and right upper panels 116, 118 are mirror images of each other. Each of the panels 112, 114, 116, 118 includes four bottle holders or sleeves 140. All sixteen holders have the same construction with a large circle 142 at one end and a small circle 144 at the other end and a wire 146 connecting them. The wire 148 is straight except for a short angled portion 149 connecting to the small circle 144 and provided to accommodate for the bottle geometries. The bottles 104 are then held with their narrow neck (cap and cork ends) 150 passing through the small circle 142 and the neck or bottle shoulder engaging and holding the bottle. And the large circle 142 encircles the bottle base 156 holding it in place.

Each of the groups of four bottle holders (140) is welded to a respective tall narrow U-shaped wire frame 160, 162, 164, 166, with the holders spaced from one another and parallel. The top two U-shaped frames 160, 162 face or open downwardly, and the bottom two U-shaped frames 164, 166 face or open upwardly. Sleeves 170, 172, 174, 176 are fixed at the top ends of the bottom frames 164, 166, and the lower ends 180, 182, 184, 186 of the top frames 160, 162 are fitted, pressed or slipped down into respective ones of the sleeves as can be understood from FIGS. 7 and 9.

The upper cross members 190, 192 of the top U-shaped frames 160, 162 are straight. In contrast, the lower cross members 196, 198 of the lower U-shaped frames 164, 166 curve upwardly in the centers thereof. These upwardly curved portions 202, 204 of the two lower frames then fit into corresponding downwardly curving portions 208, 210 of cross piece 214 of the base assembly 120. They are essentially cradled therein to restrain movement of the U-shaped frames 164, 166 horizontally relative to the base assembly 120.

The base cross piece 214 slants up from sides of the flat rectangular frame 220 of the base assembly 120 to the center where the downwardly curving portions 208, 210 are, as can be seen at the bottom of FIG. 5 for example. This raises the curved ends 222, 224 of the lower ends of the U-shaped frames 164, 166 off of the ground or rack support surface. This can be seen, for example, at the bottom of FIG. 3.

Welded at the tops of the lower U-shaped frames 164, 166 are wide U-shaped brackets 230, 232, respectively, both facing downwardly. These brackets 230, 232 are attached at their center bars 240, 242 centered just beneath the sleeves 170, 172, 174, 176.

The base assembly 120 has at opposite ends thereof pairs of posts 250, 252, 254, 256 extending up from frame 220. Each pair is braced by an angled bracket 258, 259, respectively. And as depicted in FIG. 7, for example, each post has a sleeve 260, 262, 264, 266 at its top for receiving down therein the ends 270, 272, 274, 276 of the brackets with a tight fit, similar to the previously-discussed sleeve fit shown in FIG. 9. Thus, the two lower panels 116, 118 are held to the base assembly 120 by the four sleeve fits and also the two cradle fits on cross piece 214.

The first clip 124 holds the left and right bottom panels 112, 114 together. The second clip 126 holds the upper panels 116, 118 together. The third clip 128 holds the top and bottom left panels 112, 116 together, and the fourth clip 130 holds the right ones together. The clips 124, 126, 128, 130 are shown in FIG. 7, for example, and the operation of one is detailed in FIG. 8. Other clip designs are possible but they should be sturdy, reliable, easy to install and easy to remove.

The left top and bottom panels form a left column of bottle holders, all facing in one direction. And the right top and bottom panels form a right column, all facing in the other direction. This opposite facing provides a good forward to backward balance in the rack 100 of the heavy wine bottles, better than that of the rack 50 of FIG. 1. In fact, the clip and other connections are secure enough that the rack 100 when loaded with sixteen full bottles can be lifted at the top securely and balanced.

If desired, as when the user is moving his possessions to another location, the rack 100 can be easily disassembled in a reverse procedure and packed back into the box 136, as shown in FIG. 7. The clips 124, 126, 128, 130 are unclipped, the top panels 116, 118 pulled off the bottom panels 112, 114, and the bottom panels 112, 114 pulled out of and off the base assembly 120.

From the foregoing detailed description, it will be evident that there are a number of changes, adaptations and modifications of the present invention which come within the province of those skilled in the art. However, it is intended that all such variations not departing from the spirit of the invention be considered as within the scope thereof as limited solely by the claims appended hereto.

What is claimed:

1. A knock-down bottle rack, comprising:

a base assembly;

a first panel attachable to and detachable from said base assembly, said first panel including a plurality of bottle first holders; and a second panel attachable to said base assembly in a generally parallel orientation to said first panel when attached to said base assembly, said second panel being detachable from said base assembly, said second panel including a plurality of bottle second holders;

wherein said first panel includes an elongate upwardly-facing U-shaped member to which said first holders are directly affixed, and a wider downwardly-disposed wider U-shaped member having a top cross-piece to which said upwardly-facing U-shaped member is affixed and having downward ends releasably attachable to said base assembly.

2. The rack of claim 1 further comprising: a third panel attachable to and on top of said first panel and detachable therefrom, said third panel including a plurality of bottle third holders; and a fourth panel attachable to and on top of said second panel and detachable therefrom, said fourth panel including a plurality of bottle fourth holders.

3. The rack of claim 2 wherein all of said bottle holders are adapted to hold the respective bottles therein at a downward angle towards tops thereof.

4. The rack of claim 3 wherein said first and third holders are adapted to hold bottles facing towards a front of said base assembly, and said second and fourth holders are adapted to hold bottles facing in an opposite direction towards a rear of said base assembly.

5. The rack of claim 3 wherein the downward angle is approximately twenty-five degrees from the horizontal.

6. The rack of claim 2 wherein said first panel includes upward sleeves into which lower ends of said third panel releasably fit.

7. The rack of claim 2 further comprising a first clip releasably clipping said first and said third panels together and a second clip releasably clipping said second and fourth panels together.

8. The rack of claim 7 further comprising a third clip releasably clipping said first and second panels together, and a fourth clip releasably clipping said third and fourth panels together.

9. The rack of claim 2 further comprising a third clip releasably clipping said first and second panels together, and a fourth clip releasably clipping said third and fourth panels together.

10. The rack of claim 2 wherein said first and third holders are adapted to hold bottles facing towards a front of said base assembly, and said second and fourth holders are adapted to hold bottles facing in an opposite direction facing towards a rear of said base assembly.

11. The rack of claim 1 wherein said base assembly includes a member on which a lower cross member of said upwardly-facing U-shaped member is supported.

12. The rack of claim 1 wherein said base assembly includes a cradle assembly for cradle receiving lower central portions of said first and second panels.

13. The rack of claim 12 wherein said lower central portions have upwardly curving portions, said cradle assembly has a downwardly curving portion, and said upwardly curving portions fit down into said downwardly curving portion.

14. The rack of claim 1 wherein each of said bottle holders comprises a bottle sleeve.

15. The rack of claim 1 wherein each of said holders includes a large opening for holding a bottle base, a smaller opening for holding a smaller bottle neck, and structure holding said large and smaller openings in spaced relation.

16. The rack of claim 15 wherein said large opening, said smaller opening and said structure comprise a single formed wire strand.

17. The rack of claim 1 wherein said base assembly includes a base lower frame and upright members for receiving therein lower ends of said first and second panels for upright attachment to said base lower frame.

18. The rack of claim 17 wherein said base assembly includes a generally upright bracket secured to said base lower frame and bracing said upright members.

19. The rack of claim 1 wherein said base assembly includes sleeves into which said downward ends fit.

20. The rack of claim 1 wherein each of said panels and said base assembly are formed using essentially only a bent wire construction.

21. The rack of claim 1 wherein said bottle holders comprise wine bottle holders, and the knock-down bottle rack thereby defines a knock-down wine bottle rack.

22. A knock-down bottle rack, comprising:

a base assembly;

a first panel attachable to and detachable from said base assembly, said first panel including a plurality of bottle first holders; and a second panel attachable to said base assembly in a generally parallel orientation to said first panel when attached to said base assembly, said second panel being detachable from said base assembly, said second panel including a plurality of bottle second holders;

wherein said base assembly includes a cradle assembly for cradle receiving lower central portions of said first and second panels.

23. The rack of claim 22 further comprising: a third panel attachable to and on top of said first panel and detachable therefrom, said third panel including a plurality of bottle third holders; and a fourth panel attachable to and on top of said second panel and detachable therefrom, said fourth panel including a plurality of bottle fourth holders.

24. The rack of claim 23 wherein all of said bottle holders are adapted to hold the respective bottles therein at a downward angle towards tops thereof.

25. The rack of claim 24 wherein said first and third holders are adapted to hold bottles facing towards a front of said base assembly, and said second and fourth holders are adapted to hold bottles facing in an opposite direction towards a rear of said base assembly.

26. The rack of claim 24 wherein the downward angle is approximately twenty-five degrees from the horizontal.

27. The rack of claim 23 wherein said first and third holders are adapted to hold wine bottles facing towards a front of said base assembly, and said second and fourth holders are adapted to hold bottles facing in an opposite direction facing towards a rear of said base assembly.

28. The rack of claim 23 wherein said first panel includes upward sleeves into which lower ends of said third panel releasably fit.

29. The rack of claim 23 further comprising a first clip releasably clipping said first and said third panels together and a second clip releasably clipping said second and fourth panels together.

30. The rack of claim 29 further comprising a third clip releasably clipping said first and second panels together, and a fourth clip releasably clipping said third and fourth panels together.

31. The rack of claim 23 further comprising a third clip releasably clipping said first and second panels together, and a fourth clip releasably clipping said third and fourth panels together.

32. The rack of claim 22 wherein each of said holders includes a large opening for holding a bottle base, a smaller opening for holding a smaller bottleneck, and structure holding said large and smaller openings in spaced relation.

33. The rack of claim 32 wherein said large opening, said smaller opening and said structure comprise a single formed wire strand.

34. The rack of claim 22 wherein said base assembly includes a base lower frame and upright members for receiving therein lower ends of said first and second panels for upright attachment to said base lower frame.

35. The rack of claim 34 wherein said base assembly includes a generally upright bracket secured to said base lower frame and bracing said upright members.

36. The rack of claim 22 wherein said first panel includes an elongate upwardly-facing U-shaped member to which said first holders are directly affixed, and a wider downwardly-disposed wider U-shaped member having a top cross-piece to which said upwardly-facing U-shaped member is affixed and having downward ends releasably attachable to said base assembly.

37. The rack of claim 36 wherein said base assembly includes sleeves into which said downward ends fit.

38. The rack of claim 36 wherein said base assembly includes a member on which a lower cross member of said upwardly-facing U-shaped member is supported.

39. The rack of claim 22 wherein said lower central portions have upwardly curving portions, said cradle assembly has a downwardly curving portion, and said upwardly curving portions fit down into said downwardly curving portions.

40. The rack of claim 22 wherein each of said bottle holders comprises a bottle sleeve.

41. The rack of claim 22 wherein each of said panels and said base assembly are formed using essentially only a bent wire construction.

42. The rack of claim 22 wherein said bottle holders are wine bottle holders, and the knock-down bottle rack thereby defines a knock-down wine bottle rack.

43. A knock-down bottle rack, comprising:

a base assembly;

a first panel attachable to and detachable from said base assembly, said first panel including a plurality of bottle first holders; and a second panel attachable to said base assembly in a generally parallel orientation to said first panel when attached to said base assembly, said second panel being detachable from said base assembly, said second panel including a plurality of bottle second holders;

wherein said base assembly includes a base lower frame, upright members for receiving therein lower ends of said first and second panels for upright attachment to said base lower frame, and a generally upright bracket secured to said base lower frame and bracing said upright members.

44. The rack of claim 43 further comprising: a third panel attachable to and on top of said first panel and detachable therefrom, said third panel including a plurality of bottle third holders; and a fourth panel attachable to and on top of said second panel and detachable therefrom, said fourth panel including a plurality of bottle fourth holders.

45. The rack of claim 44 wherein all of said bottle holders are adapted to hold the respective wine bottles therein at a downward angle towards tops thereof.

46. The rack of claim 45 wherein said first and third holders are adapted to hold bottles facing towards a front of said base assembly, and said second and fourth holders are adapted to hold bottles facing in an opposite direction towards a rear of said base assembly.

47. The rack of claim 45 wherein the downward angle is approximately twenty-five degrees from the horizontal.

48. The rack of claim 44 wherein said first and third holders are adapted to hold bottles facing towards a front of said base assembly, and said second and fourth holders are adapted to hold bottles facing in an opposite direction facing towards a rear of said base assembly.

49. The rack of claim 44 wherein said first panel includes upward sleeves into which lower ends of said third panel releasably fit.

50. The rack of claim 44 further comprising a first clip releasably clipping said first and said third panels together and a second clip releasably clipping said second and fourth panels together.

51. The rack of claim 50 further comprising a third clip releasably clipping said first and second panels together, and a fourth clip releasably clipping said third and fourth panels together.

52. The rack of claim 44 further comprising a third clip releasably clipping said first and second panels together, and a fourth clip releasably clipping said third and fourth panels together.

53. The rack of claim 43 wherein each of said holders includes a large opening for holding a bottle base, a smaller opening for holding a smaller bottle neck, and structure holding said large and smaller openings in spaced relation.

54. The rack of claim 53 wherein said large opening, said smaller opening and said structure comprise a single formed wire strand.

55. The rack of claim 43 wherein said first panel includes an elongate upwardly-facing U-shaped member to which said first holders are directly affixed, and a wider downwardly-disposed wider U-shaped member having a top cross-piece to which said upwardly-facing U-shaped member is affixed and having downward ends releasably attachable to said base assembly.

56. The rack of claim 55 wherein said base assembly includes sleeves into which said downward ends fit.

57. The rack of claim 55 wherein said base assembly includes a member on which a lower cross member of said upwardly-facing U-shaped member is supported.

58. The rack of claim 43 wherein said base assembly includes a cradle assembly for cradle receiving lower central portions of said first and second panels.

59. The rack of claim 58 wherein said lower central portioned have upwardly curving portions, said cradle assembly has a downwardly curving portion, and said upwardly curving portions fit down into said downwardly curving portion.

60. The rack of claim 43 wherein each of said bottle holders comprises a bottle sleeve.

61. The rack of claim 43 wherein each of said panels and said base assembly are formed using essentially only a bent wire construction.

62. The rack of claim 43 wherein said bottle holders each compose wine bottle holders, and the knock-down bottle rack thereby defines a knock-down wine bottle rack.

63. A knock-down bottle rack, comprising:

a base assembly;

a first panel attachable to and detachable from said base assembly, said first panel including a plurality of bottle first holders;

a second panel attachable to said base assembly in a generally parallel orientation to said first panel when attached to said base assembly, said second panel being detachable from said base assembly, said second panel including a plurality of bottle second holders;

a third panel attachable to and on top of said first panel and detachable therefrom, said third panel including a plurality of bottle third holders;

a fourth panel attachable to and on top of said second panel and detachable therefrom, said fourth panel including a plurality of bottle fourth holders;

wherein all of said bottle holders are adapted to hold the respective bottles therein at a downward angle towards tops thereof;

wherein said first and third holders are adapted to hold bottles facing towards a front of said base assembly, and said second and fourth holders are adapted to hold bottles facing in an opposite direction towards a rear of said base assembly;

wherein said base assembly includes upward sleeves into which downward ends of said first and second panels releasably fit;

wherein said first panel includes upward sleeves into which lower ends of said third panel releasably fit;

wherein said second panel includes upward sleeves into which lower ends of said fourth panel releasably fit;

a first clip releasably clipping said first and said third panels together;

a second clip releasably clipping said second and fourth panels together;

a third clip releasably clipping said first and second panels together; and a fourth clip releasably clipping said third and fourth panels together.

64. The rack of claim 63 wherein said base assembly includes upright brackets for bracing said base assembly sleeves upright.

65. The rack of claim 63 wherein said bottle holders comprise wine bottle holders, and said knock-down bottle rack thereby defines a knock-down wine bottle rack.

* * * * *